US007146687B2

(12) United States Patent
Kaim

(10) Patent No.: US 7,146,687 B2
(45) **Date of Patent: *Dec. 12, 2006**

(54) DEVICE FOR SECURING SHEETS OF PAPER, MATERIAL, CLOTH, ETC.

(76) Inventor: John T. Kaim, 12 Pearl St., Camden, ME (US) 04843

( * ) Notice: Subject to any disclaimer, the term of this patent is extended or adjusted under 35 U.S.C. 154(b) by 0 days.

This patent is subject to a terminal disclaimer.

(21) Appl. No.: 11/327,255

(22) Filed: Jan. 6, 2006

(65) Prior Publication Data

US 2006/0107495 A1 May 25, 2006

Related U.S. Application Data

(63) Continuation of application No. PCT/US2004/021760, filed on Jul. 8, 2004.

(51) Int. Cl.
*B42F 1/02* (2006.01)

(52) U.S. Cl. ..... 24/67.3

(58) Field of Classification Search ..... 24/67 R, 24/67.3, 67.5, 67.9, 67.11, 530, 545, DIG. 8, 24/DIG. 9, 3.12, 3.11; 281/44, 45, 48, 49
See application file for complete search history.

(56) References Cited

U.S. PATENT DOCUMENTS

| | | | | |
|---|---|---|---|---|
| 911,287 | A | 2/1909 | Berne | |
| 1,221,996 | A | 4/1917 | Kahn | |
| 1,287,764 | A | 12/1918 | Sanderson | |
| 1,439,138 | A | 12/1922 | White | |
| 1,443,443 | A | 1/1923 | Tanner | |
| 1,623,034 | A | 3/1927 | Heath et al. | |
| 1,704,737 | A | 3/1929 | Goodman et al. | |
| 1,736,558 | A | 11/1929 | Van Buren | |
| 1,869,032 | A | 7/1932 | Van Buren | |
| 2,234,294 | A | 3/1941 | Van Buren | |
| 2,553,370 | A | 5/1951 | Huppert | |
| 3,018,532 | A | 1/1962 | Rinaldi | |
| 3,167,329 | A | 1/1965 | Ernst | |
| 3,898,717 | A | 8/1975 | Schwartz | |
| 3,924,307 | A | 12/1975 | Tate | |
| 4,897,898 | A * | 2/1990 | Chapin | 24/3.12 |
| 4,991,269 | A | 2/1991 | Kuroda | |
| 6,848,150 | B1 | 2/2005 | Kaim | |

FOREIGN PATENT DOCUMENTS

WO WO2005/007420 A2 1/2005

* cited by examiner

*Primary Examiner*—James R. Brittain
(74) *Attorney, Agent, or Firm*—Cooper & Dunham LLP

(57) ABSTRACT

A binding device is provided for holding sheets of paper and other material of diverse sizes and shapes which allows the paper/material to be easily removed and reinserted. The device includes a rigid frame, first and second lips formed on the rigid frame (the second lip including a first set of teeth), a flexible spring member and at least one adjustable spacer block adjustably positioned on the spring member. One end of the spring member is attached to the first lip. A second set of teeth is formed at the other end of the spring member. The spring member is placed in a closed position by maneuvering the spring member to align the first and second sets of teeth. When the spring member is in the closed position, the paper/material is held securely between the at least one adjustable spacer block and the base surface.

12 Claims, 10 Drawing Sheets

FIG.1B
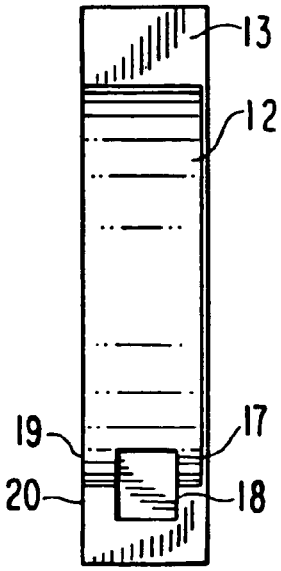
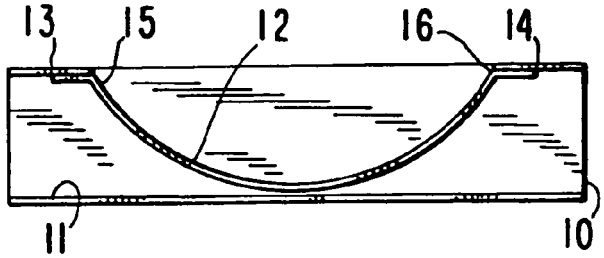
FIG.1C
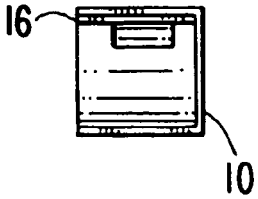
FIG.1A

DEVICE FOR SECURING SHEETS OF PAPER, MATERIAL, CLOTH, ETC.

CROSS-REFERENCE TO RELATED APPLICATIONS

This application is a continuation of International Application No. PCT/US2004/021760, filed Jul. 8, 2004 and designating the United States, which claims the priority of U.S. application Ser. No. 10/616,217, filed Jul. 8, 2003 and entitled "DEVICE FOR SECURING PAPERS, SHEETS OF MATERIAL, CLOTH, ETC.", now U.S. Pat. No. 6,848,150, issued Feb. 1, 2005.

FIELD

The present disclosure relates to a binding device for securing sheets of paper, material, cloth, etc., which allows the sheets to be easily removed and reinserted.

BACKGROUND

Many devices have been proposed for binding sheets of paper, as a means for organizing the sheets of paper. Some conventional paper binding devices require holes punched in the sheets. The punching of holes sometimes removes relevant information. The punched holes also may render the sheets more susceptible to wear and tear.

Many paper binding devices involve complex mechanisms which are time consuming to operate and expensive to manufacture.

There remains a need for binding devices which do not require punched holes, are easy (and quick) to operate, and are cheap to manufacture.

SUMMARY

This disclosure describes improved devices and apparatuses for binding sheets of paper, of diverse size and shape (such as newspaper clippings, invoices, school papers, medical or business records, etc.). The devices may also be adapted for binding together pieces of materials, cloth, etc. (such as transparencies, pants, other clothing, etc.). Binding devices according to the present disclosure provide an apparatus for conveniently and securely holding papers or sheets of material of varying widths and thicknesses without the need to create holes in the sheets of paper or other material.

BRIEF DESCRIPTION OF THE DRAWINGS

The present disclosure would be more readily understood from the following detailed description by referring to the accompanying drawings wherein:

FIGS. 1A, 1B and 1C show front, top and side views, respectively, of a binding device, according to one embodiment of the present disclosure;

DETAILED DESCRIPTION

Figure 2:
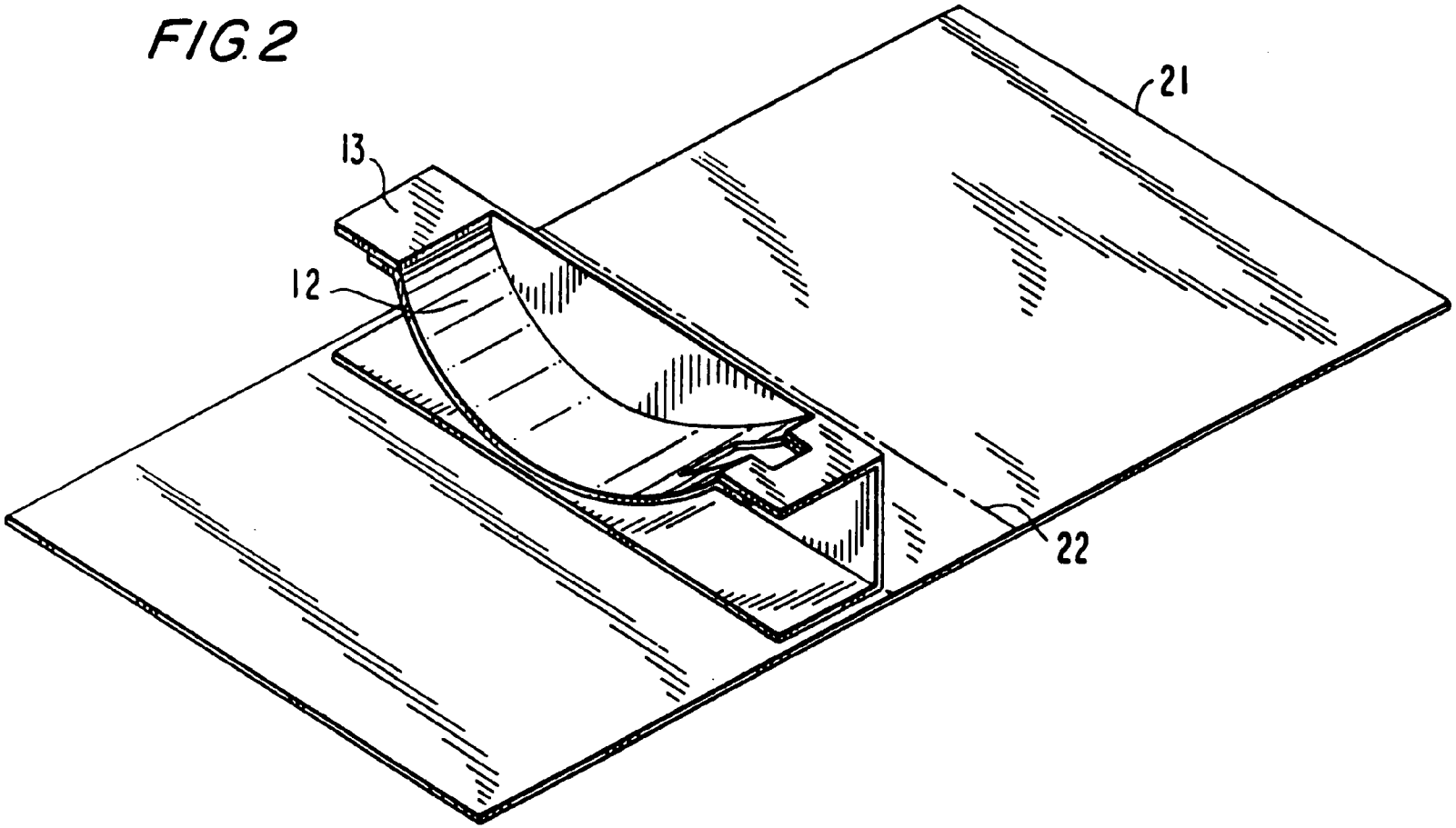
FIG. 2 shows a perspective view of a binding device, according to one embodiment.

In describing examples and preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

A device for binding paper, sheets of material, cloth, etc., according to one example of this disclosure, may comprise a rigid frame including a base surface, a first lip formed on the rigid frame, a second lip formed on the rigid frame, a flexible spring member having first and second ends, and preferably at least one adjustable spacer block. The second lip includes a first set of teeth. The spring member includes a second set of teeth formed at the second end of the spring member. The first end of the spring member may be attached to the first lip. The spring member is placed in a closed position by maneuvering the spring member to align the second set of teeth with the first set of teeth, respectively. When the spring member is in the closed position, said one or more of sheets of paper, cloth and other materials are held securely between the at least one adjustable spacer block and the base surface.

The binding device may optionally include additional means for securing the spring member in place against the paper, sheets of material, cloth, etc. The additional means may include a pin and a first hole formed in a vertical surface of the rigid frame, the axis of the first hole being substantially perpendicular with a base surface of the rigid frame, and the pin may be inserted in the first hole after the spring member is placed in the closed position.

According to another example, the device may include at least one pin, at least one first hole formed in a vertical surface of the rigid frame, and at least one second hole formed in the rigid frame. The axis of the first hole is substantially perpendicular with the base surface of the rigid frame. The first and second holes may have a diameter corresponding to a diameter of the pin, and the pin may be inserted within either of the first and second holes.

The first end of the spring member of the device may optionally be rotatably attached to the first lip, and may rotate about an axis substantially perpendicular to the base surface of the rigid frame.

The flexible spring member of the device may optionally be integrated with the first lip of the rigid frame. The flexible spring member of the device may be detachable from, and reattachable to, the rigid frame. The flexible spring member of the device may include at least one recess formed thereon for holding nonplanar objects. The flexible spring member of the device may include a hinge positioned between the first end of the spring member and the second end of the spring member, and may be rotated about an axis parallel to the base surface.

The binding device may optionally include a cover element attached to the rigid frame, and/or at least one retaining ridge formed at or near an exterior edge of the first lip or the second lip.

A material holding apparatus, according to an example, may comprise a rigid frame including a base surface, a first lip formed on the rigid frame, a second lip formed on the rigid frame, a flexible spring member having first and second ends, and preferably at least one adjustable spacer block adjustably positioned on the spring member. The second lip includes a first set of teeth. The spring member includes a second set of teeth formed at the second end. The first end of the spring member may be attached to the first lip. The spring member may be placed in a closed position by guiding the spring member to align the second set of teeth with the first set of teeth. When the spring member is in the closed position, said one or more of sheets of paper, cloth and other materials are held securely between the at least one adjustable spacer block and the base surface.

The material holding apparatus may optionally include additional means for securing the spring member in place against the paper, sheets of material, cloth, etc. The additional means may include a pin and a first hole formed in a vertical surface of the rigid frame. The axis of the first hole can be substantially perpendicular with a base surface of the rigid frame. The pin is inserted in the first hole after the spring member is placed in the closed position.

According to another example, the apparatus may include at least one pin, at least one first hole formed in a vertical surface of the rigid frame, and at least one second hole formed in the rigid frame. The first and second holes may have a diameter corresponding to a diameter of the pin, and the pin may be inserted within either of the first and second holes.

The first end of the spring member of the material holding apparatus optionally may be rotatably attached to the first lip and may rotate about an axis substantially perpendicular to the base surface of the rigid frame.

The flexible spring member of the apparatus may be integrated with the first lip of the rigid frame. The flexible spring member of the apparatus may be detachable from, and reattachable to, the rigid frame. The flexible spring member of the apparatus may include at least one recess formed thereon for holding nonplanar objects. According to another embodiment, the flexible spring member of the apparatus may include a hinge positioned between the first end of the spring member and the second end of the spring member, and may be rotated about an axis parallel to the base surface.

The material holding apparatus may optionally include a cover element attached to the rigid frame, and/or at least one retaining ridge formed at or near an exterior edge of the first lip or the second lip.

To further explain the subject matter of this disclosure, we describe some additional examples and exemplary embodiments in connection with the figures and their supporting descriptions provided below.

Referring to FIGS. 1A–1C, a binding device 1 for securing papers or sheets of material, according to a first exemplary embodiment, includes a rigid frame 10, a first lip 13 and a second lip 14 formed on the rigid frame, and a flexible arcuate spring member 12 attached to the first lip such that papers or sheets of material are held against a base surface 11 of the rigid frame.

The operation of the binding device 1 includes coupling of a second set of teeth 19 formed at an end of the flexible arcuate spring member 12 with a matching first set of teeth 20 in the second lip 14. In addition, gaps 17 and 18 are provided in the respective sets of teeth through which the opposing set of teeth can be guided. It should be noted that the gap 18 is wider than the width of each of the teeth 19, and the gap 17 is wider than the width of each of the teeth 20, in order to allow one of the teeth 19 to be maneuvered through gap 18, and one of the teeth 20 through gap 17 (discussed below).

The first lip 13 and the second lip 14 are formed on the rigid frame 10. Formed on the second lip 14 is the set of teeth 20. The set of teeth 20 includes the gap 18 formed therebetween. As shown in FIG. 1B, there are two teeth in the set. One skilled in the art should appreciate, however, that there may be two or more teeth in each set.

The rigid frame 10 may be constructed from one or more of a variety of suitable materials selected based upon material strength, manufacturability, cost, and other considerations. The base surface 11 of the rigid frame 10 can be securely attached to a cover element 21 (FIG. 2), using any suitable conventional fasteners or fastener means.

The cover element 21 may be a rectangular sheet of rigid or semi-rigid material. The cover element 21 can include a plurality of folds 22 and preferably is dimensioned so as to envelop and form a protective cover around the papers or sheet material held within the binding device.

Alternative embodiments may include varied attachment orientations of the rigid frame 10 relative to the cover element 21 to accommodate paper or sheets of material of a variety of dimensions or layouts. The cover element 21 may also be dimensioned so as to be larger or smaller than a length of the rigid frame 10 along the long axis of the rigid frame. Further, the cover element 21 may be formed of only a single sheet of unfolded material (not shown), such that the cover element 21 does not envelop and form a protective cover over the papers or sheet material held by the binding device, yet allows for convenient handling of the binding device.

Alternative embodiments may also include planar or nonplanar rigid frame base surfaces of dimensions allowing for different mounting orientations of the rigid frame to the cover element, or to other surfaces. The base surface of the rigid frame may be elongated or shortened to allow more efficient securing of the rigid frame to the cover element. Further, holes or shapes of other geometry may be formed in the base surface to allow the rigid frame to be attached to other planar or nonplanar surfaces.

The dimensions of the flexible arcuate spring member 12 will typically depend on the dimensions of the rigid frame 10, and in particular a length of the spring member depends on a length of the rigid frame 10 (that is, the frame length, measured along the long axis of the frame, will typically be the controlling dimension). The spring member 12 is dimensioned such that the spring member 12 spans a distance between the first lip 13 and the second lip 14. The spring member 12 may be constructed from any suitable material or materials having spring properties.

Referring to FIGS. 1A–1C, a first end 15 of the spring member 12 of the first embodiment is attached to the first lip 13 of the frame 10 through the use of conventional fasteners or other fastening means. Formed upon an opposing end 16 (hereinafter "free end") of the spring member 12 is the set of teeth 19 with the gap 17 formed therebetween.

Due to arcuate profile and spring properties of the spring member 12, the overall length of the spring member increases as the spring member is flattened through the application of force. The spring member 12, the gap 17, the gap 18, the set of teeth 19, and the set of teeth 20 are dimensioned to allow for expansion of the overall length of the spring member when it is compressed to bind a large thickness of paper or sheet material being held in the binding device.

Figure 4B:
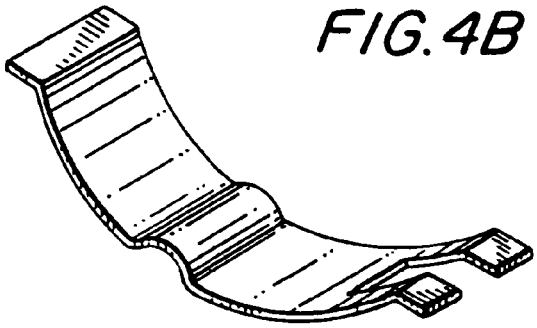
FIGS. 4A and 4B show perspective views of flexible spring members, according to one embodiment.
Figure 4A:
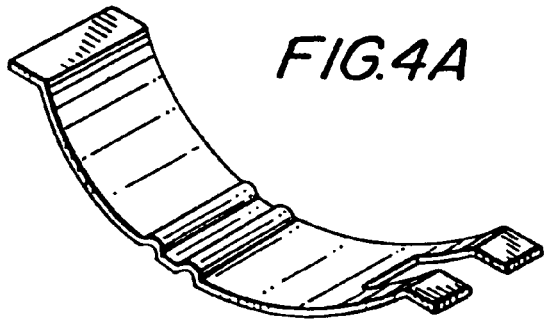

In alternative embodiments, the flexible arcuate spring member may be formed with one or more relief indentations in the arcuate portion of the spring member, as shown in FIGS. 4A and 4B. The relief indentations may allow for the convenient holding of one or more writing instruments in conjunction with the papers or sheet materials held by the binding device.

In operation, the binding device is placed in a closed position by maneuvering the free end 16 of the spring member 12 above the second lip 14, such that one of the first set of teeth 19 is aligned with the second gap 18 formed in the second lip. A force is applied to the spring member 12 to guide the aligned tooth 19 through the second gap 18 and to bring the spring member 12 into contact with the base surface 11 of the rigid frame 10. The spring member 12 is compressed as the tooth 19 is guided through and below the second gap 18. The spring member 12 is then moved in a direction perpendicular to the long axis of the rigid frame to align the first set of teeth 19 with the second set of teeth 20 formed in the second lip 14.

The spring compressing force is then removed, allowing the spring force of the spring member 12 to secure the free end 16 against the second lip formed upon the rigid frame.

In the closed position, the spring force of the compressed spring member 12 therefore acts upon the first lip 13, the second lip 14, and the base surface 11. Paper or sheet material positioned on the base surface 11 and under the spring member 12 is thus held against the base surface by the compressive force of the spring member. The binding device is opened by reversing the closing operation.

Figure 3:
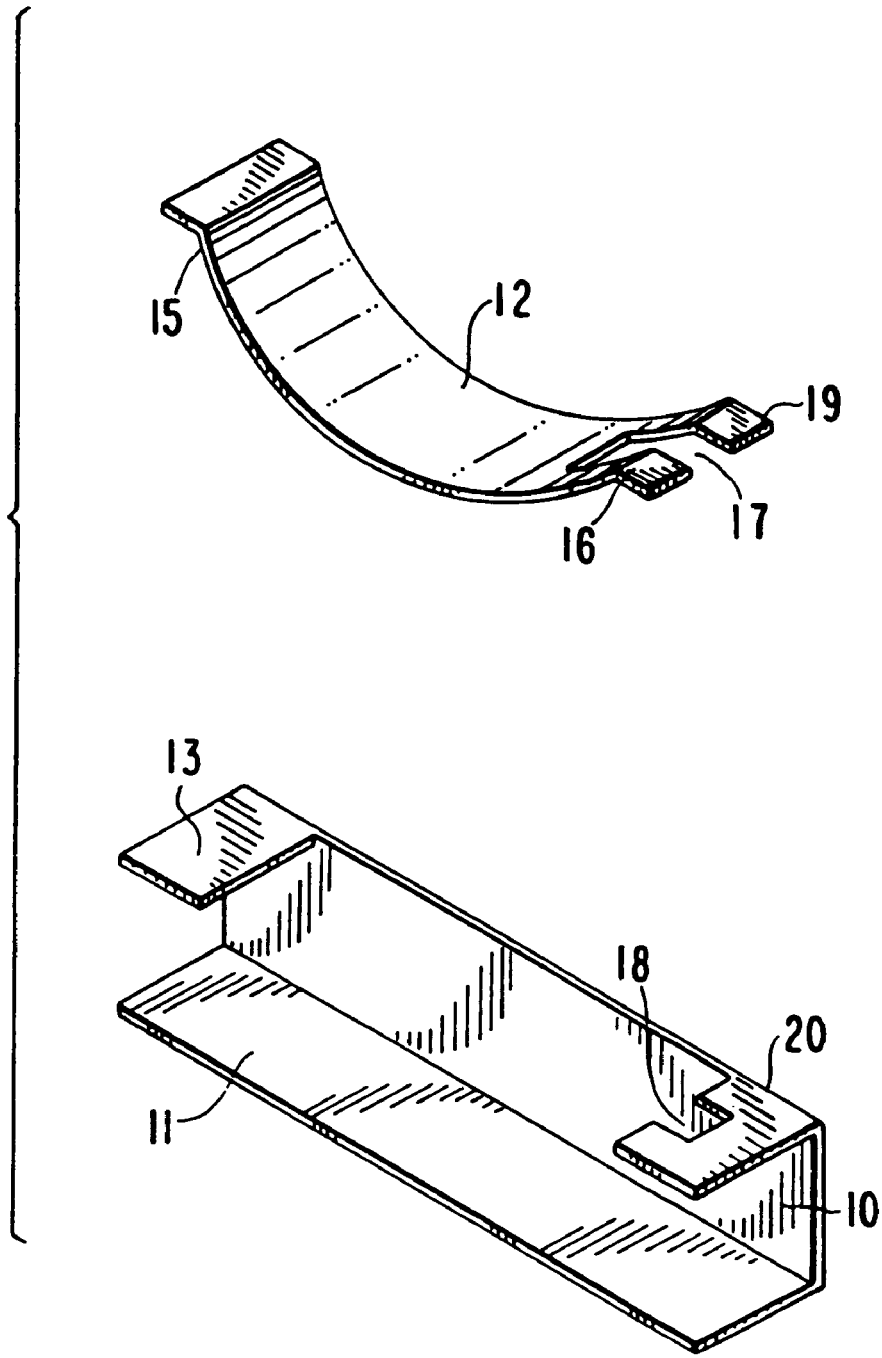
FIG. 3 shows an perspective exploded assembly view of a binding device, according to one embodiment.
Figure 5:
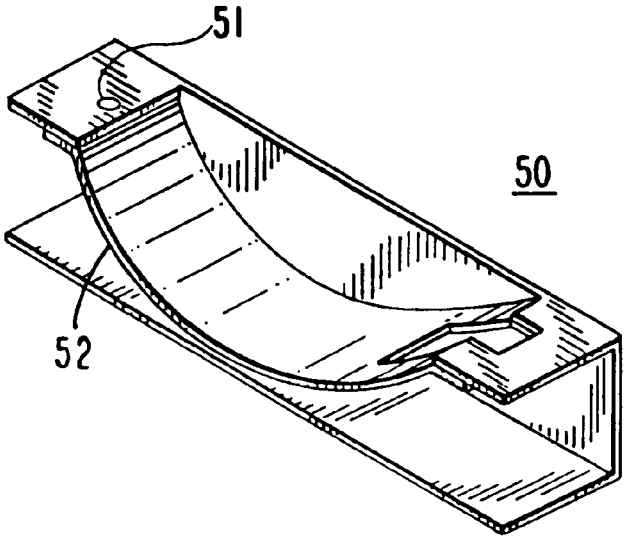
FIG. 5 shows a perspective view of a binding device including a rotatably attached flexible spring member, according to a second embodiment.

A second embodiment is explained below with reference to FIG. 5. Binding device 50 includes a rigid frame, base surface, first and second lips, first and second sets of teeth, and first and second gaps, in a configuration substantially similar to that of the first embodiment described above and shown in FIGS. 1–3. Corresponding elements will be described with reference to the numbers assigned in FIGS. 1–3.

The binding device 50 also includes a flexible arcuate spring member 52 rotatably attached to the first lip 13. An end of the spring member 52 is rotatably attached about a pivoting fastener 51 having an axis substantially normal to the surface of the first lip 13. The pivot may be constructed of any suitable conventional fastener or fastening means.

The rotatable attachment of the spring member 52 can allow rotation of the spring member about an axis substantially perpendicular to the base surface 11, to allow a greater range of motion of the spring member 52 and to allow for greater ease of use of the binding device.

The rotatable attachment may be constructed such that the spring member 52 can be temporarily detached from, and conveniently reattached to, the rigid frame 10, allowing for greater ease of use and portability of the device.

The rotatable attachment of the spring member 52 may also allow for greater ease of use of the binding device due to a reduction in a quantity of force required to perform the closing and opening operations as described above.

According to a third embodiment (FIG. 6), binding device 60 includes a rigid frame, base surface, first and second lips, first and second sets of teeth, and first and second gaps, in a configuration substantially similar to that of the first embodiment described above. Corresponding elements will be described with reference to the numbers assigned in FIGS. 1–3.

The binding device 60 also includes a flexible arcuate spring member 61 attached to the first lip 13. The spring member 61 may be constructed so as to contact the base surface when the spring member is in the closed position, or to form a gap 62 between a surface of the spring member and the base surface when the spring member is in a closed position. The binding device of the third embodiment may be used for holding or binding a variety of apparel items or other objects having similar geometry, and the gap 62 may be modified by varying dimensions of the spring member 61.

Additionally, at least one adjustable spacer block 63 is preferably utilized to modify and enhance the binding action of the device, by acting as extensions of the binding surface of the spring member. As the spring member is put in the closed position, the spacer block 63 can be used to adjust the gap 62 between the surface of the spring member and the base surface 11 of the rigid frame, to accommodate materials of different thicknesses.

Figure 6A:
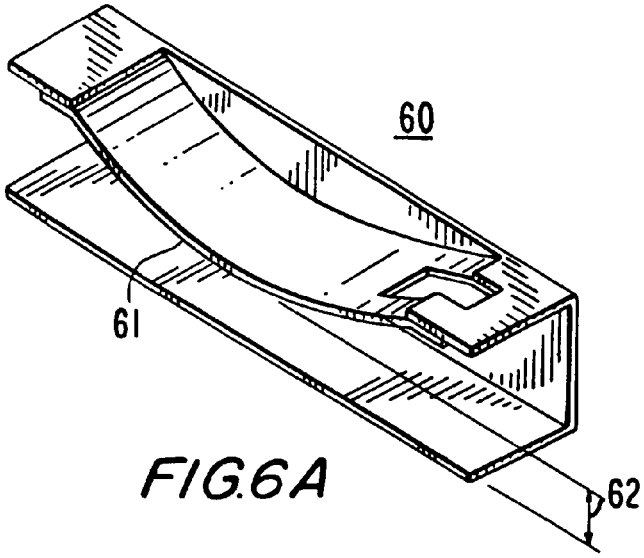
FIGS. 6A and 6B show a perspective view of a binding device configured to hold apparel and other similar materials and a front view of a spacer block, respectively, according to a third embodiment.
Figure 6B:
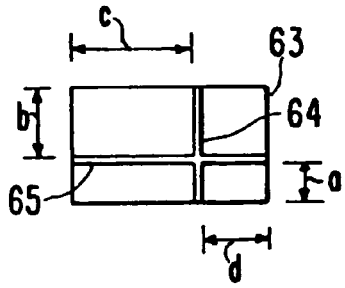

Referring to FIG. 6B, the spacer block 63 may include offset mounting grooves 64, 65 for mounting of the block to the spring member. The offset grooves 64, 65 allow adjustment of the gap 62 by selection of the orientation of the block relative to the base surface. Referring to FIG. 6B, two offset grooves 64, 65 may provide four different dimensions, a, b, c, and d, allowing at least four adjustments to be made to the binding effect of the spring member, depending upon the orientation of the spacer block 63 to the spring member 61. A larger number of available adjustment dimensions may be possible by the creation of additional offset grooves in the spacer block 63.

According to another example, the spacer block may include a screw or other threaded fastener which allows the spacer block to be adjusted in position in a normal direction relative to the base surface of the frame. For example, if a larger stack of sheets is desired to be held by the device, the threaded spacer block can be adjusted in a direction away from the frame to provide more space for the stack of sheets. On the other hand, if it is found that the sheets are loosely held, the threaded spacer block can be adjusted in a direction towards the frame to hold the sheets more securely. The spacer block preferably includes a base made of a plastic, rubber or composite material which does not readily damage the sheets.

According to another example, the spacer block may be held to the spring member by Velcro® fastener material (or similar material). For example, a strip of Velcro® fastener material may be secured to the bottom surface of the spring member (which faces the base surface of the frame), and a complementary piece of Velcro® fastener material is secured to the surface of the spacer block which faces the bottom surface of the spring member. Thus, the spacer block can be moved from one location along the spring member to another location, as desired.

Figure 6C:
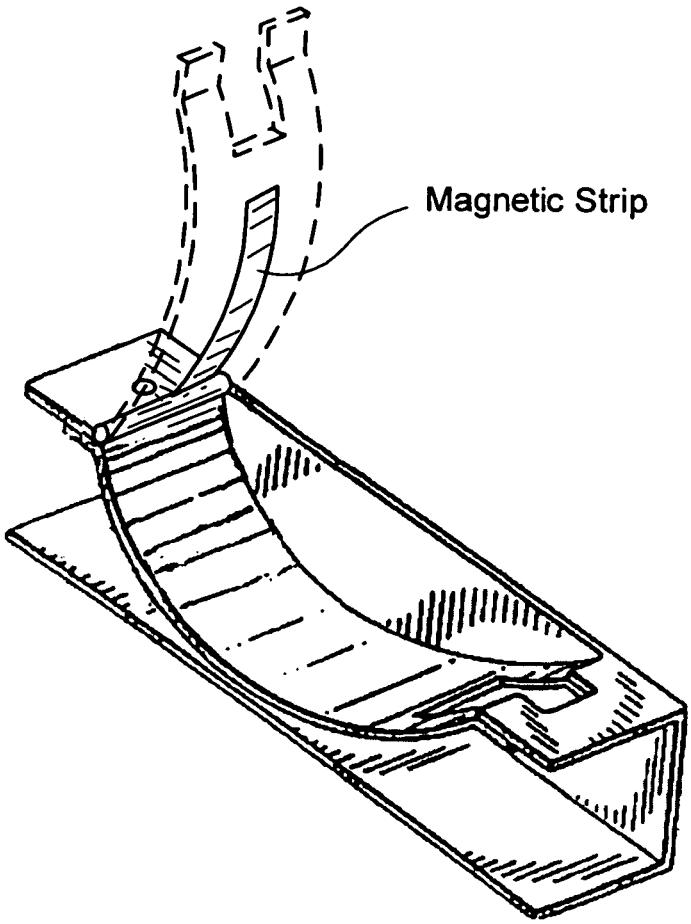
FIG. 6C shows another example of a binding device, wherein the spacer block is held to the spring member by a magnetic strip attached to the spring member.
Figure 6D:
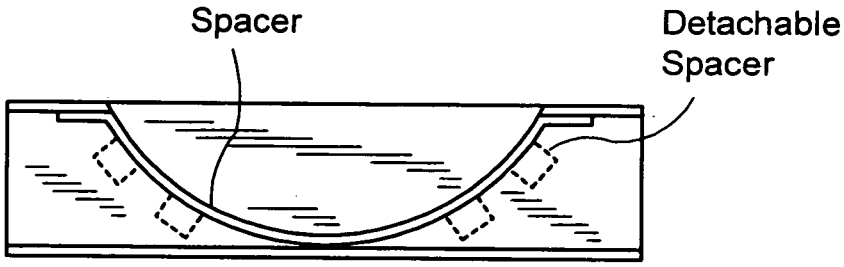
FIG. 6D shows another example of a binding device, wherein the spacer block is constructed of a magnetic material.

According to another example, the spacer block may be held to the spring member by a magnetic strip attached to the spring member (as shown exemplarily in FIG. 6C), or if the spring member is of a suitable material, the spacer block itself may be constructed of a magnetic material as shown in FIG. 6D. The spacers may be moved toward the center of the spring as the thickness of material to be bound is increased. Spacer blocks might also be attached to the spring member by mechanical means such as slotted attachments or snuggly fitting holes.

Figure 7:
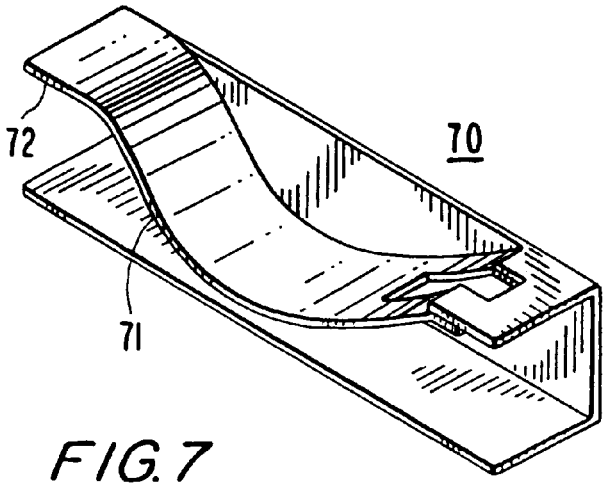
FIG. 7 shows a binding device having an integrated flexible spring member and rigid frame, according to a fourth embodiment.

A fourth embodiment is explained below with reference to FIG. 7. Binding device 70 includes a rigid frame, a base surface, a second lip, first and second sets of teeth, and first and second gaps in a configuration substantially similar to that of the first embodiment described above. Corresponding elements will be described with reference to the numbers assigned in FIGS. 1–3.

The binding device 70 also includes a flexible arcuate spring member 71 formed integrally with the first lip 72.

The integrally-formed spring member and lip of the fourth embodiment allow for greater reliability and useful life of the binding device. Further, the binding device 70 may provide advantages in ease of manufacture and material selection.

Figure 11:
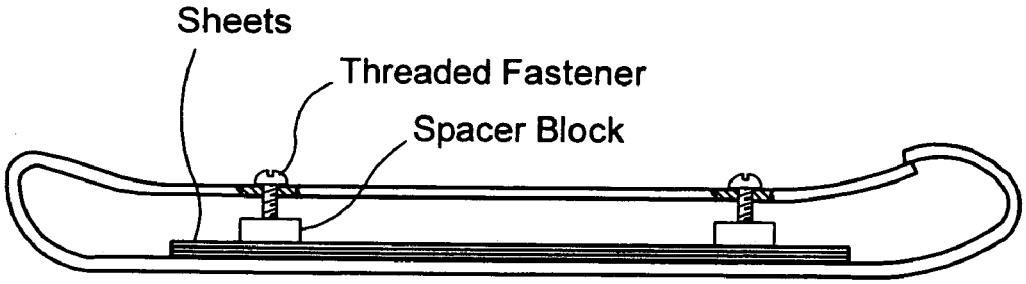
FIG. 11 shows a binding device, according to another example, wherein the spring member and rigid frame are integrally formed from a metal strip.

As another example (FIG. 11), the frame and spring member can be integrally formed from a metal strip (such as made of spring steel, aluminum, etc.). Such a device can be integrated with a hanger for holding, for example, a skirt, a pair of pants, etc.

Figure 8:
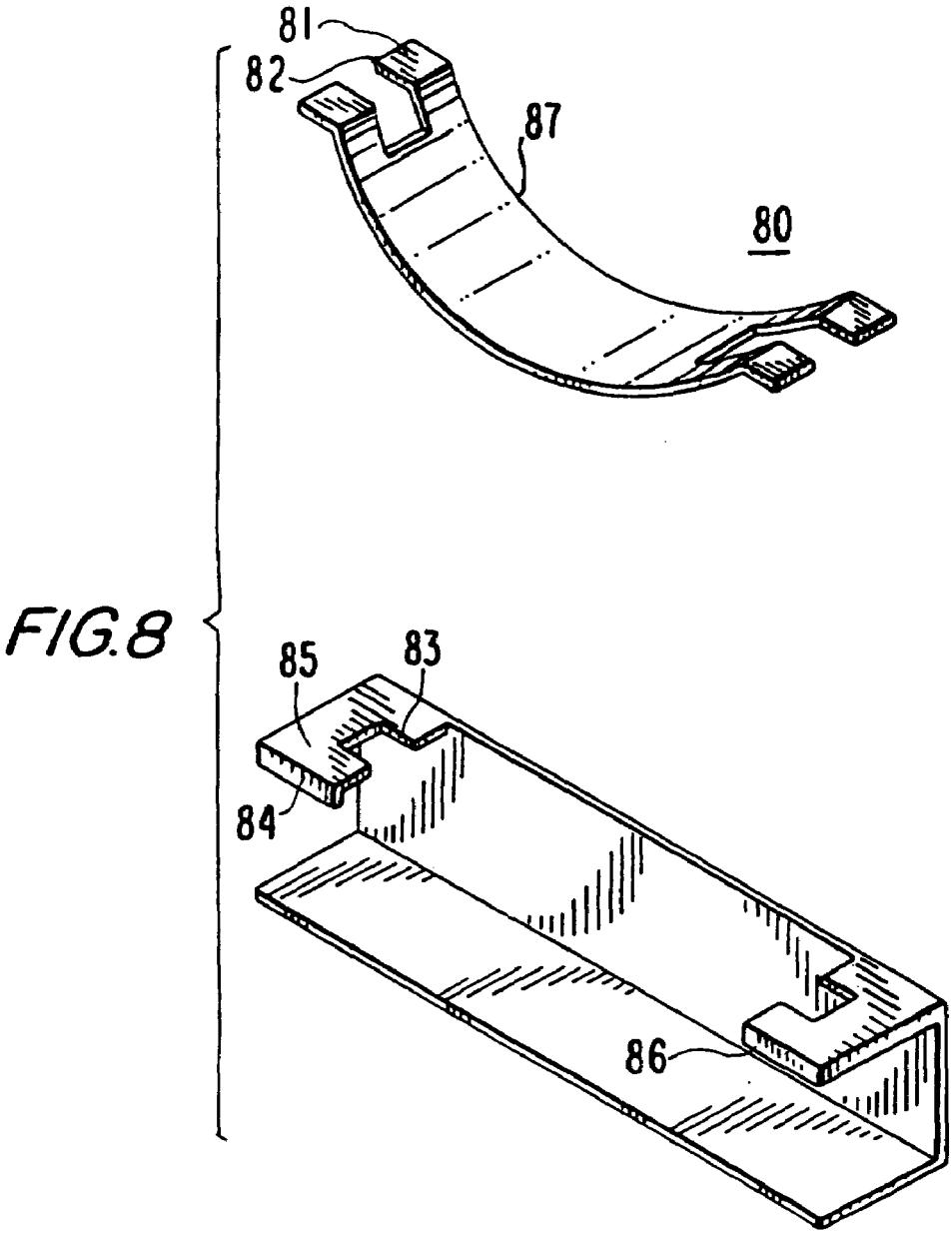
FIG. 8 shows a binding device having a detachable flexible spring member and rigid frame, according to a fifth embodiment.

According to a fifth embodiment (FIG. 8), binding device 80 includes a rigid frame, base surface, a second lip, first and second sets of teeth, and first and second gaps in a configuration substantially similar to that of the first embodiment described above. Corresponding elements will be described with reference to the numbers assigned in FIGS. 1–3.

The binding device 80 also includes a flexible arcuate spring member 87 that is unattached to either the first lip or the second lip of the rigid frame 10. The spring member 87 may be constructed and dimensioned so as to additionally include a set of teeth 81 formed at an end opposite the free end 16, and a gap 82 formed therebetween.

Correspondingly, the lip 85 of the frame of the fifth embodiment may include a fourth set of teeth 83 and a fourth gap 84 formed therebetween. Additionally, retaining ridges 86 may be formed at or near the edges of the first lip 85 and the second lip 14, for holding the spring member in place and for allowing ease of operation of the binding device. The configuration of the fifth embodiment may provide greater ease of use of the binding device by allowing the closing operation to be performed with respect to either end of the spring member 87.

Figure 9A:
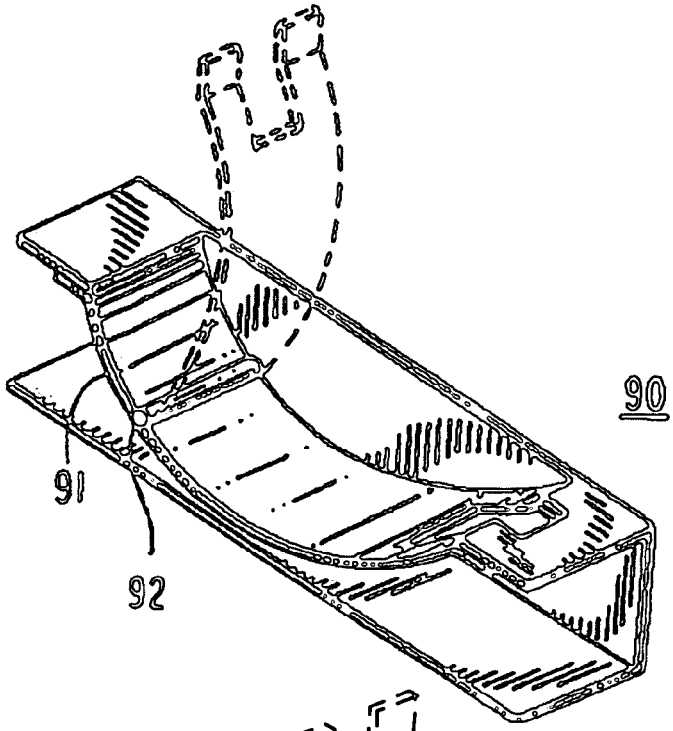
FIG. 9A shows a binding device having a flexible spring member including a hinge and a rigid frame, according to a sixth embodiment.

A sixth embodiment is explained below with reference to FIG. 9A. Binding device 90 includes a rigid frame, base surface, first and second lips, first and second sets of teeth, and first and second gaps in a configuration substantially similar to that of the first embodiment described above. Corresponding elements will be described with reference to the numbers assigned in FIGS. 1–3.

The binding device 90 also includes a flexible arcuate spring member 91 attached to the first lip 13. The spring member 91 may be constructed so as to include a hinge 92 dividing the spring member. The hinge 92 may allow the spring member to be conveniently manipulated and the papers or sheets of material to be easily inserted and removed. The hinge may preferably be located near to a point of attachment of the spring member 91 to the first lip 13.

Figure 9B:
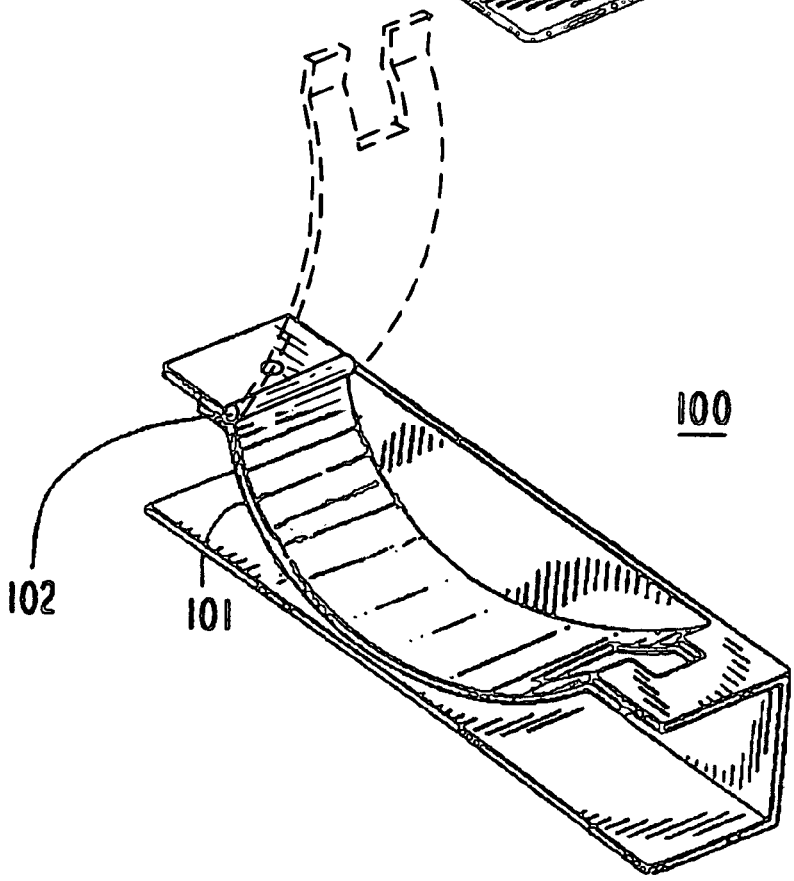
FIG. 9B shows a binding device having a flexible spring member attached to a hinge located upon a rigid frame, according to a seventh embodiment.

A seventh embodiment is explained below with reference to FIG. 9B. Binding device 100 includes a rigid frame, base surface, first and second lips, first and second sets of teeth, and first and second gaps in a configuration substantially similar to that of the first embodiment described above. Corresponding elements will be described with reference to the numbers assigned in FIGS. 1–3.

The binding device 100 also includes a flexible arcuate spring member 101. A hinge 102 may be attached to the first lip 13, with the spring member 101 being attached to the hinge. The hinge 102 may allow the spring member to be conveniently manipulated and the papers or sheets of material to be easily inserted and removed. The hinge 102 may be rigidly attached to the first lip 13 or may be rotatably attached via an optional pivot 103. When a pivot is used to facilitate manipulation of the spring member, the teeth 17–20 may be omitted.

Figure 10:
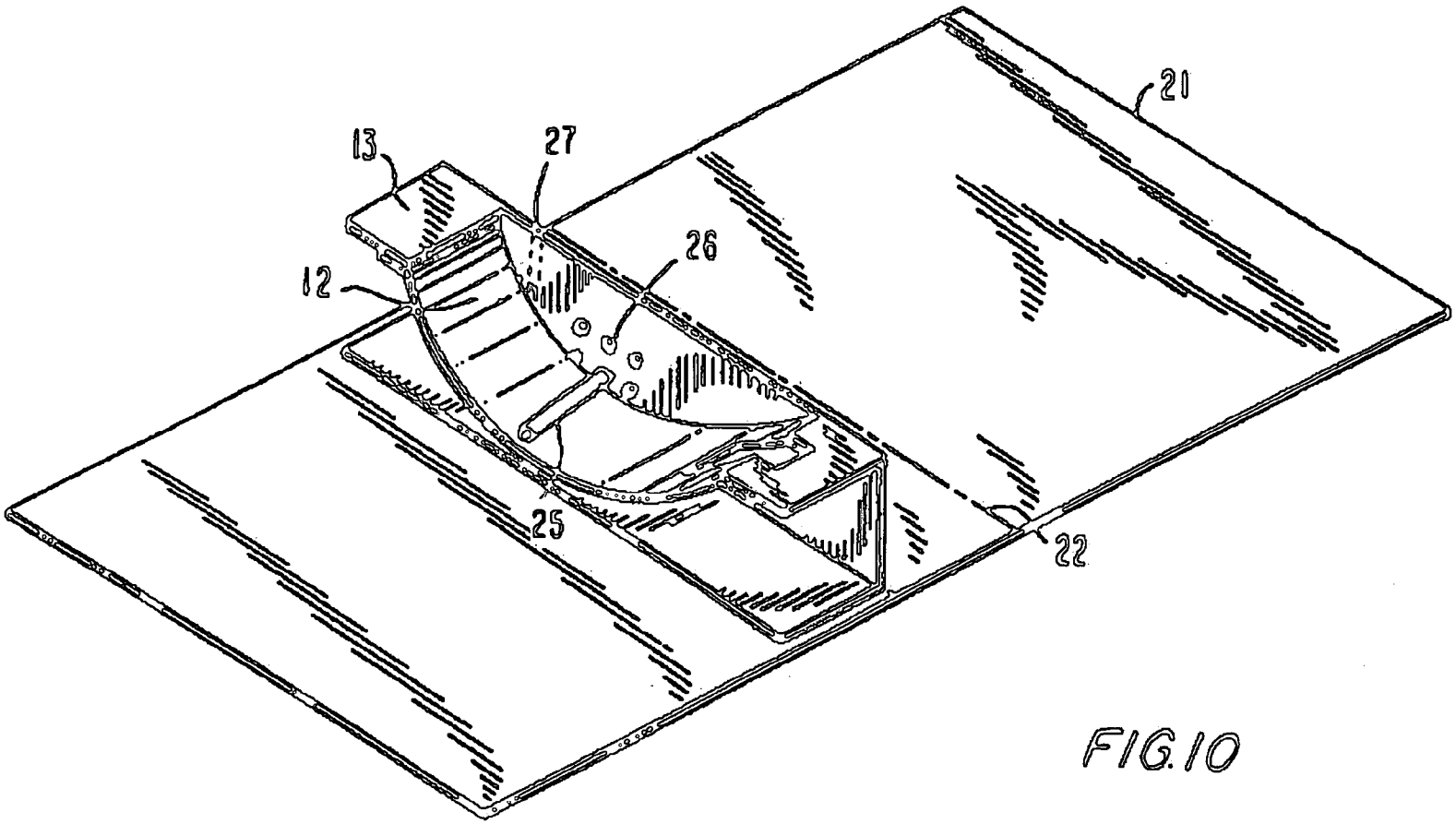
FIG. 10 shows a perspective view of a binding device according to another embodiment, including a spring support pin, spring support pin holes, and spring support pin storage hole.

The spring member may be secured in place against the papers and/or sheets of material by an additional mechanism. For example, the binding device of FIG. 2 may be adapted as shown in FIG. 10.

Binding device 1 may include one or more spring support pins 25. The spring support pin 25 may be formed in a generally cylindrical shape, and may have a length corresponding approximately to a width of the rigid frame 10 and/or a width of the spring member 12. The spring support pin 25 may be constructed of any suitable rigid or semi-rigid material.

The spring support pin 25 may be flexibly attached to either of the spring member 12, rigid frame 10 or cover element 21. Attachment may be in the form of a link constructed of a flexible material, such as a thread or rope, or may be in the form of a metal chain or other similar suitable attachment mechanism. Alternatively, the pin may be unattached from any of the above-identified elements.

One or more spring support pin holes 26 may be formed in a vertical surface of the rigid frame 10. A spring support pin hole 26 may be formed having a diameter corresponding to a diameter of the spring support pin 25, such that the pin 25 can fit snugly and securely in the pin hole 26. When plural spring support pin holes 26 are included, the plural holes 26 may be positioned in vertical or horizontal alignment, or in a matrix or grid pattern spaced upon the vertical surface of rigid frame 10, spaced to provide the user with a variety of pin hole locations into which the pin can be inserted.

Additionally, one or more optional spring support pin storage holes 27, having a diameter approximately equal to the diameter of the spring support pin holes 26, may be formed in the rigid frame 10.

The spring support pin 25 can be inserted into one of spring support pin holes 26 after the spring member 12 has been placed in a closed position in the manner described above.

When plural spring support pin holes 26 are included, the pin hole into which the spring support pin 25 is inserted can be selected based upon a location of an upper surface of the spring member 12 when the spring member is in the above-described closed position. When the pin is inserted within the pin hole in such an instance, the spring support pin 25 supports and applies a force against the compressed spring member 12 to prevent upward movement (that is, away from the base) of the spring member and cause the spring member 12 to maintain contact with, and exert downward pressure on, the paper or sheet material placed thereunder. The free end of the pin may optionally be configured in the shape of an asymmetric cam pressing down even further on the spring member with a twist. Thus, the spring locking mechanism can serve as both a spacer and a lock.

When not inserted into spring support pin hole 26, the spring support pin 25 can be inserted into the spring support pin storage hole 27.

The above specific examples and embodiments are illustrative, and many variations can be introduced on these examples and embodiments without departing from the spirit of the disclosure or from the scope of the appended claims. For example, elements and/or features of different illustrative examples and embodiments may be combined with each other and/or substituted for each other within the scope of this disclosure and appended claims. In addition, improvements and modifications which become apparent to persons of ordinary skill in the art after reading this disclosure, the drawings and the appended claims are deemed within the spirit and scope of the present disclosure.

For example, while assorted examples and exemplary embodiments discussed above and shown in the drawings show the rigid frame and lips as an integral structure, it should be apparent that a rigid frame subassembly and a lips subassembly may be held together by two or more fasteners (more example, screw and wing nut, or nut and bolt).

Additional variations may be apparent to one of ordinary skill in the art from reading International Application No. PCT/US2004/021760 and U.S. application Ser. No. 10/616,217 (now U.S. Pat. No. 6,848,150, issued Feb. 1, 2005), the entire contents of each of which are incorporated herein by reference.

What is claimed is:

1. A material holding apparatus comprising:

a rigid frame including a base surface;

first and second lips formed on the rigid frame, the second lip including a first set of teeth;

a flexible spring member having first and second ends, the first end of the spring member being attached to the first lip, and the spring member including a second set of teeth formed at the second end; and at least one adjustable spacer block adjustably positioned on the spring member, wherein the spring member is placed in a closed position by guiding the spring member to align the second set of teeth with the first set of teeth, and when the spring member is in the closed position, material is held securely between the at least one adjustable spacer block and the base surface.

2. The apparatus of claim 1, wherein the spacer block is held to the spring member by a threaded fastener.

3. The apparatus of claim 1, wherein the spacer block is held to the spring member by a fastener device.

4. The apparatus of claim 1, wherein the spacer block includes a magnetic material.

5. The apparatus of claim 1, wherein the spacer block is held to the spring member by a mechanical device.

6. The apparatus of claim 1, further comprising additional means for securing the spring member in place against the material.

7. The apparatus of claim 6, wherein said additional means comprises:

at least one pin;

at least one first hole formed in a vertical surface of the rigid frame, the axis of the first hole being substantially perpendicular with the base surface of the rigid frame; and at least one second hole formed in the rigid frame, wherein the first and second holes have a diameter corresponding to a diameter of the pin, and the pin may be inserted within either of the first and second holes.

8. The material holding apparatus of claim 1, wherein the frame and spring member are integrally formed from a metal strip.

9. A material holding apparatus comprising:

a rigid frame including a base surface;

first and second lips formed on the rigid frame, the second lip including a first set of teeth;

a flexible spring member having first and second ends, the first end of the spring member being attached to the first lip, and the spring member including a second set of teeth formed at the second end; and at least one adjustable spacer block adjustably positioned on the spring member, wherein the spring member is placed in a closed position by guiding the spring member to align the second set of teeth with the first set of teeth, and when the spring member is in the closed position, material is held securely between the at least one adjustable spacer block and the base surface, and wherein the spacer block is held to the spring member by a magnetic strip attached to the spring member.

10. The material holding apparatus of claim 9, wherein the frame and spring member are integrally formed from a metal strip.

11. A material holding apparatus comprising:

a rigid frame including a base surface;

first and second lips formed on the rigid frame, the second lip including a first set of teeth;

a flexible spring member having first and second ends, the first end of the spring member being attached to the first lip, and the spring member including a second set of teeth formed at the second end;

at least one adjustable spacer block adjustably positioned on the spring member; and additional means for securing the spring member in place against the material, wherein the spring member is placed in a closed position by guiding the spring member to align the second set of teeth with the first set of teeth, and when the spring member is in the closed position, material is held securely between the at least one adjustable spacer block and the base surface, and wherein said additional means includes a pin and a first hole formed in a vertical surface of the rigid frame, the axis of the first hole being substantially perpendicular with a base surface of the rigid frame, and the pin is inserted in the first hole after the spring member is placed in the closed position.

12. The material holding apparatus of claim 11, wherein the frame and spring member are integrally formed from a metal strip.

* * * * *